US009681707B2

(12) United States Patent
Huang

(10) Patent No.: US 9,681,707 B2
(45) Date of Patent: Jun. 20, 2017

(54) METHOD FOR SECURING STUDDED SHOES BY USING THE EFFECT OF INERTIA

(71) Applicant: Ying-Chun Huang, Nantou (CN)

(72) Inventor: Ying-Chun Huang, Nantou (CN)

( * ) Notice: Subject to any disclaimer, the term of this patent is extended or adjusted under 35 U.S.C. 154(b) by 0 days.

(21) Appl. No.: 14/778,879

(22) PCT Filed: Feb. 28, 2014

(86) PCT No.: PCT/CN2014/072700
§ 371 (c)(1),
(2) Date: Jan. 6, 2016

(87) PCT Pub. No.: WO2014/146535
PCT Pub. Date: Sep. 25, 2014

(65) Prior Publication Data

US 2016/0120266 A1 May 5, 2016

(30) Foreign Application Priority Data

Mar. 19, 2013 (CN) ..... 2013 1 0088100

(51) Int. Cl.
*A43C 15/16* (2006.01)
*A43C 13/04* (2006.01)
(Continued)

(52) U.S. Cl.
CPC ..... *A43C 15/161* (2013.01); *A43B 5/001* (2013.01); *A43B 5/02* (2013.01); *A43B 5/06* (2013.01); *A43C 13/04* (2013.01); *A43C 15/165* (2013.01)

(58) Field of Classification Search
CPC .. A43B 5/00; A43B 5/02; A43C 15/16; A43C 15/161; A43C 13/04
(Continued)

(56) References Cited

U.S. PATENT DOCUMENTS 3,731,406 A 5/1973 Young
3,911,600 A * 10/1975 Dassler ..... A43B 13/26 36/67 D
(Continued)

FOREIGN PATENT DOCUMENTS

CN 1054889 10/1991
CN 1476795 2/2004
(Continued)

OTHER PUBLICATIONS

International Search Report and Written Opinion, issued in the corresponding PCT application No. PCT/CN2014/072700, dated Jun. 16, 2014, 8 pages.
(Continued)

*Primary Examiner* — Marie Bays
(74) *Attorney, Agent, or Firm* — Hamre, Schumann, Mueller & Larson, P.C.

(57) ABSTRACT

A method for securing studded shoes by using the effect of inertia, wherein a studded shoe, comprising a structure of stud and receptacle combination, the stud including a ground-engaging part. The stud and the receptacle are adapted to be secured together by a threaded connection comprising a bolt (6, 8) on one of the components of the stud and a threaded socket (5, 7) on the receptacle, both adapted such that said bolt (6, 8) can be driven into said threaded socket (5, 7). A securing means of the components serves to become inter-engaged at least when the bolt (6, 8) is fully driven into the threaded socket (5, 7) to resist unscrewing of the components. The securing means comprises at least one locking accessory that fastens in the counterclockwise direction, in an arrangement such that the direction of torque formed by the direction of the inertia in wearer's shoe sole and the center of the threaded connection, and the relative number and/or position of the threads of the threaded
(Continued)

connection determine the position and locking direction of the stud relative to the receptacle.

8 Claims, 5 Drawing Sheets

(51) Int. Cl.
*A43B 5/02* (2006.01)
*A43B 5/00* (2006.01)
*A43B 5/06* (2006.01)

(58) Field of Classification Search
USPC ..... 36/67 R, 67 D, 134
See application file for complete search history.

(56) References Cited

U.S. PATENT DOCUMENTS

| | | | | | |
|---|---|---|---|---|---|
| 3,918,181 | A | | 11/1975 | Inohara | |
| 4,063,372 | A | | 12/1977 | MacNeill | |
| 4,472,098 | A | * | 9/1984 | Kiefer | B60Q 1/0433 36/134 |
| 4,587,748 | A | * | 5/1986 | Collins | A43B 5/001 36/127 |
| 5,036,606 | A | * | 8/1991 | Erich | A43C 15/165 36/134 |
| 6,012,239 | A | * | 1/2000 | Conway | A43C 15/161 36/134 |
| 7,107,708 | B2 | * | 9/2006 | Kelly | A43C 15/161 36/127 |
| 7,137,213 | B2 | * | 11/2006 | Kelly | A43C 15/161 36/127 |
| 7,946,062 | B2 | | 5/2011 | Kelly | |
| 2005/0000119 | A1 | * | 1/2005 | McMullin | A43C 15/161 36/134 |
| 2006/0059723 | A1 | * | 3/2006 | Robinson | A43B 3/0042 36/127 |
| 2007/0062070 | A1 | * | 3/2007 | Kuhtz | A43B 1/0072 36/127 |
| 2007/0101618 | A1 | * | 5/2007 | Peake | A43B 3/0094 36/134 |
| 2011/0262245 | A1 | * | 10/2011 | Michiwaki | F16B 33/006 411/412 |
| 2013/0072990 | A1 | * | 3/2013 | Simonson | A61B 17/8625 606/301 |
| 2014/0356174 | A1 | * | 12/2014 | Wang | B64C 39/024 416/204 R |
| 2016/0016654 | A1 | * | 1/2016 | Wang | B64C 39/024 416/223 R |

FOREIGN PATENT DOCUMENTS

| | | |
|---|---|---|
| CN | 2829422 | 10/2006 |
| DE | 2540608 | 3/1977 |
| DE | 20305114 | 6/2003 |
| GB | 1082517 | 9/1967 |
| GB | 2418130 | 3/2006 |
| JP | 3042577 | 10/1997 |
| JP | 2002-325605 | 11/2002 |
| JP | 2005-013424 | 1/2005 |
| JP | 2005013424 | 1/2005 |
| TW | 516942 | 11/1990 |
| TW | 90128130 | 11/1990 |
| TW | 92108164 | 4/1992 |
| TW | 92108165 | 4/1992 |
| TW | 80202035 | 9/1992 |
| TW | 97200043 | 1/1997 |
| TW | 200304782 | 10/2003 |
| TW | 200304783 | 10/2003 |
| TW | 343406 | 11/2008 |
| TW | 201316915 | 5/2013 |
| TW | 201316916 | 5/2013 |
| WO | 02/39840 | 5/2002 |
| WO | 03/086129 | 10/2003 |

OTHER PUBLICATIONS

Search Report, issued in the corresponding Chinese Application No. 201310088100.X, dated Mar. 19, 2013, 4 pages.
First Office Action, issued in the corresponding Chinese Application No. 201310088100.X, dated Apr. 3, 2015, 6 pages.
Second Office Action, issued in the corresponding Chinese Application No. 201310088100.X, dated Jun. 16, 2015, 5 pages.
Korean Office Action, issued for corresponding Korean Patent Application No. 10-2015-7030113, mailed on Nov. 11, 2016.
Japanese Office Action, issued for corresponding Japanese Patent Application No. 2016-503526, mailed on Dec. 6, 2016.
Extended European Search Report, issued for corresponding European Patent Application No. 14769644.7, mailed on Dec. 6, 2016.
Russian Search Report, issued for corresponding Russian Patent Application No. 2015144558, mailed on Jan. 23, 2017.
Wikipedia, "Lead (engineering)", 4 pages, Jan. 22, 2013, can be found at https://en.wikipedia.org/w/index.php?title=lead_%28engineering%29&oldid=534287129.
Decision of Refusal, issued in the corresponding Japanese Patent Application No. 2016-503526, dated on Apr. 4, 2017.

* cited by examiner

METHOD FOR SECURING STUDDED SHOES BY USING THE EFFECT OF INERTIA

TECHNICAL FIELD

This invention relates to a method for securing studded shoes by using the effect of inertia, particularly to that applied to sports shoes, such as track and field shoes and footwear with replaceable wear-resistant components, including but not limited to casual shoes and jogging shoes, football shoes and golf shoes, "football" meaning all known sports of football, such as soccer, rugby, and American and Australian footballs.

BACKGROUND OF THE INVENTION

A stud refers to a part of a shoe adapted to provide friction during play of sports and has a ground-engaging part. Thus, shoes for use in football tend to have relatively sharp and pointed sole studs and golf shoes have several relatively soft and blunt traction studs. As to the footwear with replaceable wear-resistant components, they tend to have relatively round sole studs to decrease resistance and wear from engagement with ground during moving and to avoid damaging the ground and the floor. The studs can be detachably assembled to the sole of an article of footwear by a bolt on the stud connected to a corresponding threaded socket to form or to be provided securely on the sole.

A threaded connection should be designed to be able to ensure the stud remains in place without accidental detachment even when a great force is applied. In the existing arts, studs have single-start or multi-start screw threads, of which the single-start screw thread is the simplest form and, when unscrewed, has greater resistance than multi-start screw thread, also provides a strong connection after multi-turn rotation of the bolt and the threaded socket. However, regardless of single-start or multi-start screw threads, both the stud and the threaded socket incorporate a locking ratchet to prevent the stud from accidental unscrewing, typically by providing a toothed element on both the stud and the threaded socket to allow the stud and the threaded socket to be mutually engaged when the former is inserted in the latter; said toothed elements are configured to allow the stud, when it is fully inserted, to be at any of the positions relative to the threaded socket.

Taiwan's patent No. 80202035—"Socket for Studded Footwear" is a design of improvement with double-start screw-thread instead of previously corresponding meshed teeth to prevent the stud from becoming off.

Taiwan's patent No. 90128130—"Studded Footwear" is a design with meshing structure at bottom working with threaded components to prevent the stud from becoming off.

Taiwan's patent No. 92108164—"Studded Footwear" is a design using threaded components with anti-reverse, locking accessory ribs to prevent the stud from becoming off.

Taiwan's patent No. 92108165—"Studded Footwear" is a design employing the locking effect of frictional components to prevent the stud from becoming off.

Taiwan's patent No. 97200043—"Shoe spike seat structure" is a design employing the locking effect of anti-reverse positioning block to prevent the stud from becoming off.

But, none of the above-listed inventions has disclosed a method for securing the studs by employing the effect of inertia.

Hence, in some motions where greater forces are applied to the studs, e.g., lateral forces or those as a result of fast and forward acceleration of the shoe wearer, as a method for securing the studs, it will be more effective by employing the effect of inertia, and unscrewing and changing studs will be made easier.

SUMMARY OF THE INVENTION

The present invent aims to provide a method for securing studded shoes by using the effect of inertia, which ensures that a stud is locked to its corresponding threaded socket and receptacle by using inertia force. In a normal gait cycle, the foot begins to engage the ground at the outer rim or the middle of the heel, such engagement shifts swiftly toward the inside, then, along a diagonal line of the sole, gradually swifts toward the outside of the front of the sole, and shifts again toward the inside near the end of the movement, and finally the foot disengages with the ground at the inner edge or middle part of the front sole.

To fulfill the aforesaid purpose, the present invention reveals a method for securing studded shoes by using the effect of inertia, wherein securing means of components, comprising a bolt and a threaded socket, employs the fastening torque as a result of the force applied by the ground to said bolt to form the bolt and the threaded socket as tightly inter-engaging locking accessories, said securing means comprising at least a threaded socket of said locking accessory which is to be fastened in a counterclockwise direction.

In the method for securing studded shoes by using the effect of inertia stated above, said locking accessories include a structure combined by a stud with a receptacle, said stud comprising a ground-engaging part, and said stud, and said receptacle being secured to each other by a threaded connection.

In the method for securing studded shoes by using the effect of inertia stated above, said locking accessory has a adapted fastening direction which is the same as the direction of the torque of the force of inertia from the wearer's sole relative to the center of said locking accessory.

In the method for securing studded shoes by using the effect of inertia stated above, said threaded connection comprises a bolt and a threaded socket; said bolt is provided on the component of the stud, said threaded socket on said receptacle, and said bolt being able to be rotationally inserted into said threaded socket correspondingly.

In the method for securing studded shoes by using the effect of inertia stated above, the ground-engaging part of said stud and said receptacle can be in a circular or polygon shape.

In the method for securing studded shoes by using the effect of inertia stated above, at least a said threaded connection of said locking accessory that fastens in a counterclockwise direction is provided on the inner side of the sole of a shoe for right foot.

In the method for securing studded shoes by using the effect of inertia stated above, at least a said threaded connection of said locking accessory that fastens in a counterclockwise direction is provided on the outer side of the sole of a shoe for left foot.

In the method for securing studded shoes by using the effect of inertia stated above, said threaded connection has multi-start screw thread.

In the method for securing studded shoes by using the effect of inertia stated above, said receptacle can be used in any sole of all footwear.

In the method for securing studded shoes by using the effect of inertia stated above, said receptacle further comprises the combination with said stud.

The present invention also provides a studded shoe which comprises a structure combined by a stud with a receptacle, the stud including a ground-engaging part and mutually secured to the receptacle by a multi-start threaded connection; the multi-start threaded connection includes a bolt and a threaded socket, the bolt being provided on the component of one of the stud and the receptacle, the threaded socket on the other part of the stud and the receptacle, and the bolt being able to rotationally inserted into the threaded socket correspondingly. When the bolt is fully rotationally inserted into the threaded socket and enables the components like stud and the receptacle to resist unscrew, locking means of the parts that employs the effect of inertia to be fastened can at least be used to form mutual and tight attachment. Said locking means comprise at least one locking accessory that is to be fastened in a counterclockwise direction, adapted such that the torque formed relative to its center by the force applied by the ground to it during movement is in a counterclockwise direction. On the other hand, a locking accessory that is to be fastened in a clockwise direction is adapted such that the torque formed relative to its center by the force applied by the ground to it during movement is in a clockwise direction.

A multi-start threaded connection can have screw-thread with two, three or more starts, capable of reducing number of turns required for the stud to attach and detach.

The two types or all types of screw thread preferably are of the same structure, where the initial position of the stud relative to the receptacle can be determined by the number of the locking accessories and/or their positions. For example, in general a shoe for right foot can have nothing more than three clockwise locking accessories in the outer portion of the heel or further have three counterclockwise locking accessories also in the inner portion. Again, for example, a shoe for right foot can generally have only three clockwise locking accessories in the outer portion of the heel, and a shoe for left foot have three counterclockwise locking accessories also in the outer portion of the heel. Alternatively, a shoe for right foot generally can have only three clockwise locking accessories in the outer portion of the heel and three counterclockwise locking accessories in the inner portion; in the same way, a shoe for left foot has three counterclockwise locking accessories in the outer portion of the heel and three clockwise locking accessories in the inner portion.

Compared to existing arts, the present invention has the following advantages:

In the case of certain sports where consideration is needed only in whether the torque formed by the force applied by the ground relative to the center of the locking accessory is in a clockwise or counterclockwise direction to determine the fastening direction of the locking accessory and, in turn, to employ the effect of inertia to fasten the threaded socket and the receptacle that correspond to the locking accessory, without the need of complex locking means, the present method better suits the locking means of any structure, as it is ease for it to ensure precise locking of the stud relative to the receptacle. This stud may be a specifically oriented one as well, in particular a non-rotationally symmetrical stud.

DESCRIPTION OF THE REFERENCE SIGNS

Figure 1:
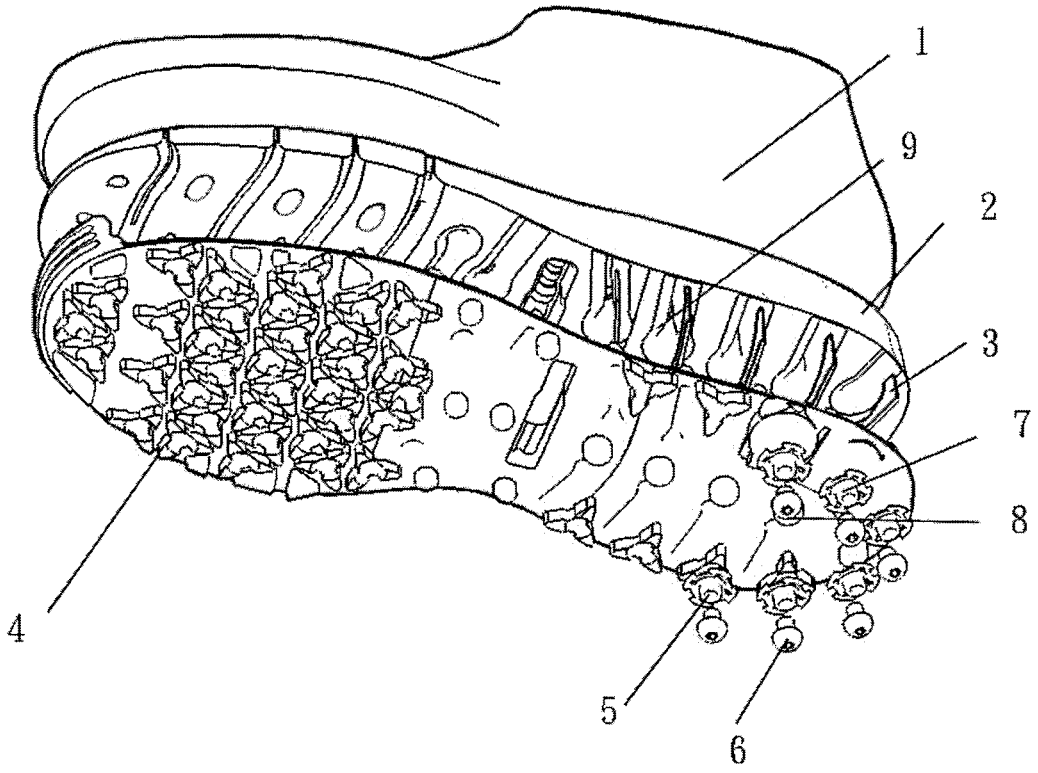
FIG. 1 is a preferred embodiment of the present invention with a method for securing studded shoes by using the effect of inertia.

1 upper
2 mid-sole
3 support piece in mid-sole
4 out-sole
5 receptacle (right-hand threaded socket)
6 right-hand threaded studs
7 receptacle (left-hand threaded socket)
8 left-hand threaded studs
9 recess

DESCRIPTION OF THE PREFERRED EMBODIMENTS

FIG. 1 shows an assembly suitable for footwear (not shown) whose wear-resistant components can be changed, comprising a upper 1, a mid-sole 2, a support piece 3 and an out-sole assembly 4, said out-sole assembly 4 comprising right-hand threaded studs 6 and left-hand threaded studs 8; the right-hand threaded studs 6 can be threaded into and received in a right-hand threaded receptacle 5, while the left-hand threaded studs 8 can be threaded into and received in a right-hand threaded receptacle 7; said out-sole assembly can be molded or attached in other manner to the sole or heel of the sport shoes mentioned above.

The right-hand threaded studs 6 or the left-hand threaded studs 8 can be a one-piece or composite component of any metal, ceramics or any plastic material, and has a threaded structure to be fastened; the stud on the sole has a ground-engaging part protruding downward and an external bolt protruding upward; as the receptacle 5 or the receptacle 7 should work in accordance with the orientation of the sole and the stud, the direction of the stud inside the receptacle is the first step of the method herein.

In a normal gait cycle, the foot begins to engage the ground at the outer rim or the middle of the heel, such engagement shifts swiftly toward the inside, then, along a diagonal line of the sole, gradually swifts toward the outside of the front of the sole, and shifts again toward the inside, and, near the end of the movement, finally the foot disengages with the ground at the inner edge of the thumb or middle part of the front sole. It is clear from the transmission track of the force mentioned above that the torque formed by the force applied by the ground on the outer side of the left heel relative to the center of the assembly of the left-hand threaded studs 8 and the receptacle 7 is in a left-hand screwing direction; hence, the locking means on the outer side of the left heel includes locking accessories of an engaging portion formed by the left-hand threaded studs 8 fastened in the left-hand screwing direction and a receptacle 7, wherein this locking means ensures that the studs on the outer side of the left heel can be automatically screwed tightly in the left-hand screwing direction by utilizing the force from the ground and cannot be unscrewed.

In contrast to the left-hand screwing locking means on the outer side of the left heel, the torque formed by the force applied by the ground on the inner side of the left heel relative to the center of the assembly of the right-hand threaded studs 6 and the receptacle 5 is in a right-hand screwing direction; hence, the locking means on the inner side of the left heel includes locking accessories of an engaging portion formed by the right-hand threaded studs 6 fastened in the right-hand screwing direction and the receptacle 5, wherein the locking means also ensures that the studs can be automatically screwed tightly in the right-hand screwing direction by utilizing the force from the ground and cannot be unscrewed.

It becomes clear by this principle that if any stud needs to be provided on the outer side of the front of a left-foot sole, it should at least include locking means that can be automatically screwed tightly in a left-hand screwing direction and cannot be unscrewed, whilst, if any stud needs to be provided on the inner side of the front of a left-foot sole, it should at least include locking means that can be automatically screwed tightly in a right-hand screwing direction and cannot be unscrewed.

When the studs on the outer side of the heel are made of selected harder materials like metal or ceramics, the material of the mid-sole 2 in the corresponding area over it can be selected to be a softer and more elastic foam if the material of the mid-sole 2 is flexible foam, while, if a flexible material, such as plastic, that is not wear-resistant is selected as the material for the studs on the inner side, the material of the mid-sole 2 in the corresponding area over it can be selected to be a harder foam. Such arrangement will allow better balanced status, give the wearer better stability when walking.

If the mid-sole 2 uses a material that is flexible and of the design of highly deformable hollow framework, such as air cushion, a recess 9 that allows support pieces 3 inside it can be provided under the air cushion. When the material selected for the stud on the outer side of the heel is a harder material, such as metal or ceramic, the air cushion recess 9 in the corresponding area over the stud can select softer support piece 3 to be inserted or have no support piece. If the material selected for the stud on the inner side is a non-wear-resistant and flexible material, such as plastic, the air cushion recess 9 in the corresponding area over the stud can select harder support piece 3 to be inserted. Such arrangement will provide better balanced status, which not only gives the wearer better stability when walking but also allows the air cushion over the stud to be compressed and deformed as a result of the stud of hard material on the outer side squeezing the air cushion when the outer side of the heel engages the ground, in turn, causing a secondary effect of spring. That, providing enhanced damping, further improves the energy recovery rate of the air cushion from 44% in the previous deflated status to 60%, and the energy recovery rate from 54% after inflation at 10 PSI to 64%, boasting a major discovery in the improvement of sole functions.

Figure 2:
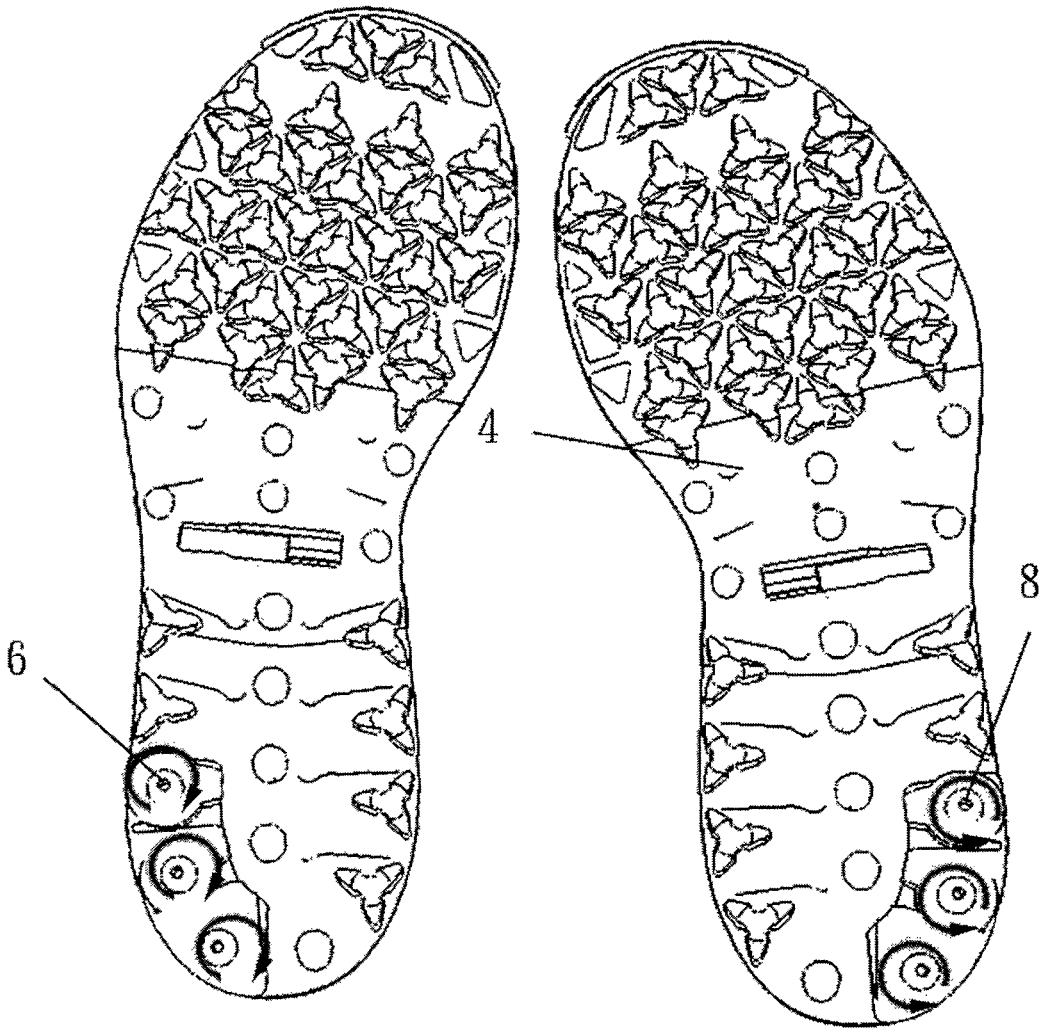
FIG. 2 is a diagram for studded shoes of the present invention in which a left shoe and a right shoe have opposite fastening directions.

FIG. 2 is the diagram showing that the studs on the outer side of heel of the present invention have opposite fastening direction between the right and left shoes; the fastening direction on the right shoe is clockwise, i.e., right-hand screwing direction, and, on the left shoe, counterclockwise, i.e., left-hand screwing direction.

Figure 3:
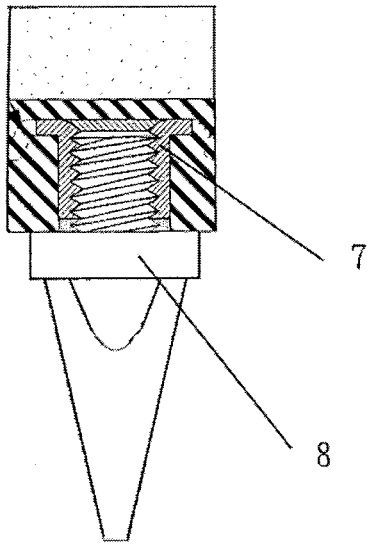
FIG. 3 is a sectional view of the receptacle assembly of the present invention that has a left-hand fastening direction.

FIG. 3 is a sectional view of a receptacle assembly of the present invention that has a left-hand fastening direction.

Figure 4:
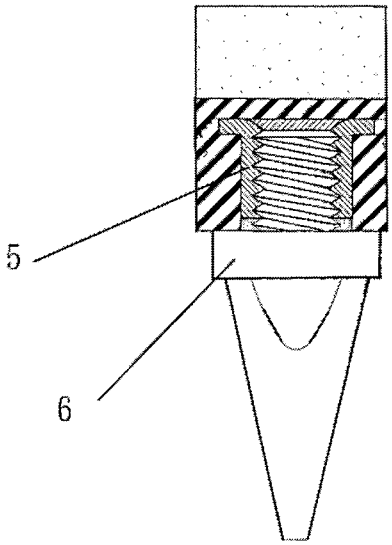
FIG. 4 is a sectional view of the receptacle assembly of the present invention that has a right-hand fastening direction.

FIG. 4 is a sectional view of a receptacle assembly of the present invention that has a right-hand fastening direction.

Figure 5:
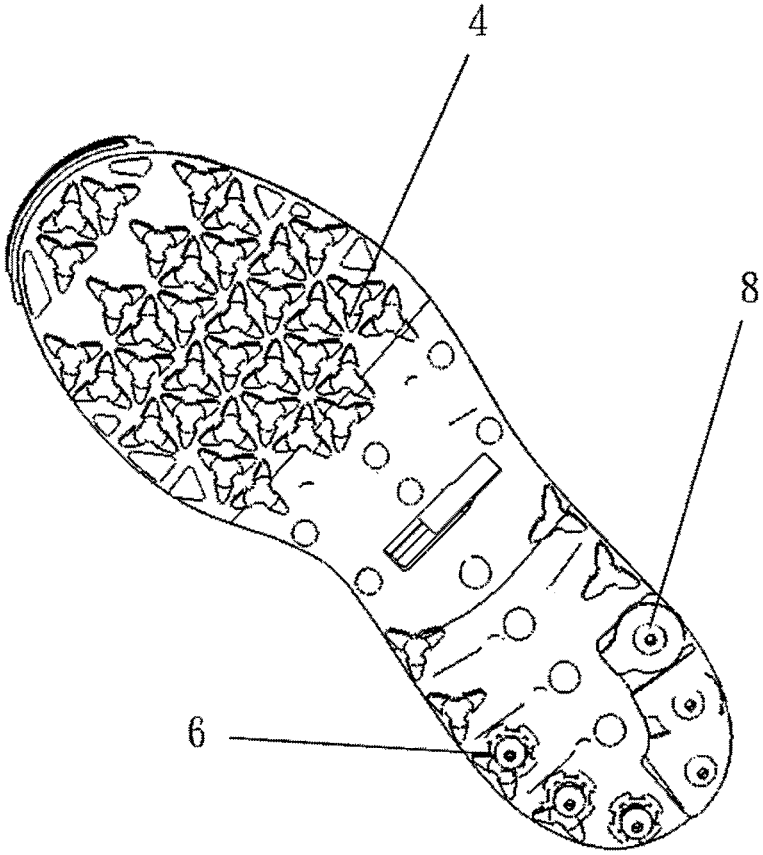
FIG. 5 is a preferred embodiment of the present invention.

FIG. 5 shows a preferred embodiment of the invention, which is the out-sole of an article of footwear that allows changing wear-resistant component, and in which the studs can be provided on both the inner and outer sides of the heels and their materials and quantities can be adjusted according to the shoe wearer's gait. For example, for a person who walks out-toeing, as generally his shoes are worn more quickly on the outer side of the heel than the inner side, more studs are provided and their material can be metal or ceramics which is more wear-resistant; in contrast, as the sole is worn less quickly on the inner side, less studs can be provided on the inner side, using any material, e.g., plastic, that is less wear-resistant. Whilst, for a person who walks in-toeing, as generally his shoes are worn more quickly on the inner side of the heel than the outer side, metal or ceramic materials that are more wear-resistant are used, while the use of less wear-resistant materials like plastics can be considered on the outer side of the heel. Also, as the studs can be changed, it is made possible, by changing new studs, to avoid knee and spinal or sole diseases caused by the shift of the pressure on the sole and of the body's center of gravity because of the worn sole, and to prolong the lifespan of the shoes under proper use.

Figure 6:
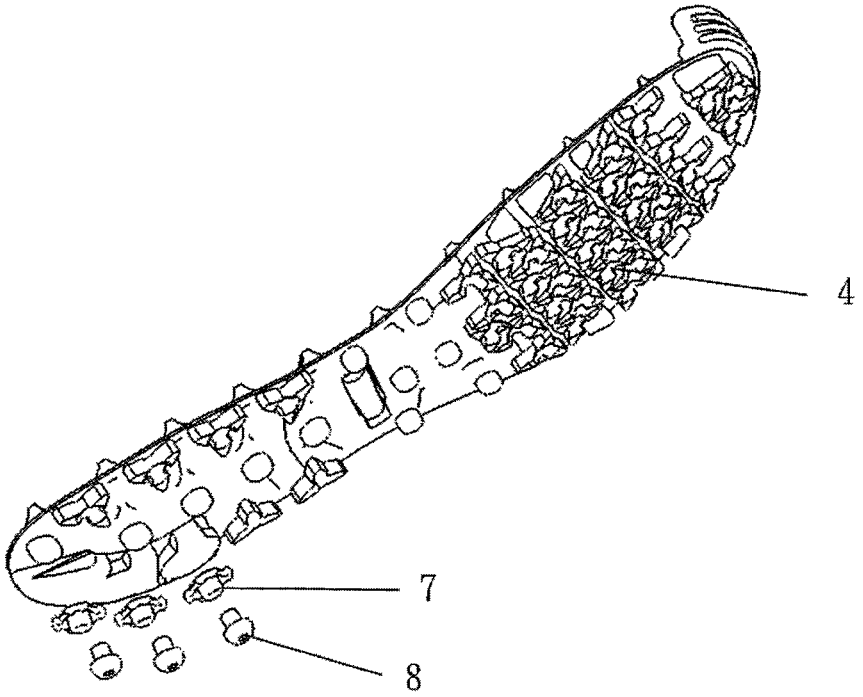
FIG. 6 is another preferred embodiment of the present invention.

FIG. 6 shows an embodiment of the present invention, in which studs are provided only on the outer side of the sole on both the right and left shoes, yet, their quantities and material can be adjusted according to wearer's gait. Because the studs on the outer side exceed the sole in height, causing the outer side of the sole higher than the inner side, which in turn causes the body's center of gravity to lean toward inside and the center of pressure on the sole to shift toward inside, this is generally used in rehabilitation and physiotherapy to relieve the pain on degenerative arthritis patients with impaired knee on the inner side and to decrease the contracting torque on the knees when the patient is walking. Also, metal or ceramic material that is more wear-resistant is used on the outer side of the heel where the sole is generally worn more quickly. Again, as the studs can be changed, it is made possible by changing stud heights to achieve the benefit of specifically decreasing the contracting torque on the knees and to prevent the knee and spinal or sole diseases caused by the shift of the pressure on the sole and of the body's center of gravity because of the worn sole; it is also possible to change the stud height as appropriate to the improvement on the degenerative arthritis patient. Changeable studs further help prolong the lifespan of shoes in proper use.

The invention claimed is:

1. A method for securing studded shoes by using the effect of inertia, comprising:

tightly inter-engaging a bolt and a threaded socket by locking accessories by utilizing a fastening torque that is formed by a force applied by a ground to said bolt, wherein the locking accessories include a structure combined by a stud with a receptacle, and the threaded socket fastens the locking accessories in a counterclockwise direction;

securing means on an outer side of a left heel of the studded shoes include locking accessories of an engaging portion formed by a threaded stud fastened in a left-hand screwing direction and a receptacle, the securing means on an inner side of the left heel of the studded shoes include locking accessories of an engaging portion formed by a threaded stud fastened in a right-hand screwing direction and a receptacle; and the securing means on an outer side of a right heel of the studded shoes include locking accessories of an engaging portion formed by a threaded stud fastened in the right-hand screwing direction and a receptacle, the securing means on an inner side of the right heel of the studded shoes include locking accessories of an engaging portion formed by a threaded stud fastened in the left-hand screwing direction and a receptacle.

2. The method for securing studded shoes by using the effect of inertia of claim 1, wherein said stud including a ground-engaging part, and said stud and said receptacle being provided and secured to each other by a threaded connection.

3. The method for securing studded shoes by using the effect of inertia of claim 1, wherein said locking accessories have a adapted fastening direction which is the same as the direction of the torque of the force of inertia from the wearer's sole relative to the center of said locking accessories.

4. The method for securing studded shoes by using the effect of inertia of claim 2, wherein said threaded connection comprises said bolt and said threaded socket, said bolt being provided on the component of said stud, said threaded socket on said receptacle, and said bolt being able to be rotationally inserted into said threaded socket correspondingly.

5. The method for securing studded shoes by using the effect of inertia of claim 2, wherein the ground-engaging part of said stud and said receptacle are in a circular or polygonal shape.

6. The method for securing studded shoes by using the effect of inertia of claim 4, wherein at least a said threaded connection of said locking accessories that fasten in a counterclockwise direction is provided on the inner side of the sole of a shoe for right foot.

7. The method for securing studded shoes by using the effect of inertia of claim 4, wherein at least a said threaded connection of said locking accessories that fasten in a counterclockwise direction is provided on the outer side of the sole of a shoe for left foot.

8. The method for securing studded shoes by using the effect of inertia of claim 4, wherein said threaded connection has multi-start screw thread.

* * * * *